US006067767A

United States Patent [19]

Schütze

[11] Patent Number: 6,067,767

[45] Date of Patent: May 30, 2000

[54] CONNECTING ELEMENT FOR MULTIPLE-SIDED, IN PARTICULAR THREE-SIDED LATTICE GIRDERS

[75] Inventor: Rainer Schütze, Braunschweig, Germany

[73] Assignee: Deutsches Zentrum fur Luft-und Raumfahrt e.V., Braunschweig, Germany

[21] Appl. No.: 09/095,487

[22] Filed: Jun. 10, 1998

[30] Foreign Application Priority Data

Jun. 11, 1997 [DE] Germany ..... 197 24 535

[51] Int. Cl.[7] ..... F16B 7/00; E04H 12/00

[52] U.S. Cl. ..... 52/655.1; 52/652.1; 52/633; 52/732.1; 403/218; 403/389; 403/391; 403/396; 403/177

[58] Field of Search ..... 52/652.1, 655.1, 52/655.2, 648.1, 633, 737.4, 737.5, 732.1, 736.3, 736.4; 403/217, 218, 389, 398, 391, 396, 177

[56] References Cited

U.S. PATENT DOCUMENTS

| | | | |
|---|---|---|---|
| 1,982,501 | 11/1934 | Douglas | 403/217 X |
| 2,238,427 | 4/1941 | Schmid | 52/731.1 X |
| 2,613,114 | 10/1952 | Hagan | 52/651.1 X |
| 2,882,099 | 4/1959 | Symons | 403/177 X |
| 2,886,359 | 5/1959 | Herrschaft | 403/396 X |
| 3,060,258 | 10/1962 | Spurgeon | 403/218 X |
| 3,243,764 | 3/1966 | McGrane et al. | 403/177 X |
| 3,685,862 | 8/1972 | Rudolf . | |
| 3,792,882 | 2/1974 | Varichon | 403/217 X |
| 4,069,832 | 1/1978 | Bingham | 52/655.1 X |
| 4,106,797 | 8/1978 | Michael | 285/133.5 |
| 4,446,666 | 5/1984 | Gilman | 52/648.1 |
| 4,900,050 | 2/1990 | Bishop et al. | 403/218 X |

FOREIGN PATENT DOCUMENTS

| | | | |
|---|---|---|---|
| 0 404 017 A1 | 12/1990 | European Pat. Off. . | |
| 867 | 4/1903 | France . | |
| 1 936 902 B2 | 4/1972 | Germany . | |
| 4-19129 | 1/1992 | Japan | 52/633 |
| 2 300 010 | 10/1996 | United Kingdom . | |

*Primary Examiner*—Laura A. Callo
*Attorney, Agent, or Firm*—Salter & Michaelson

[57] ABSTRACT

In a connecting element for multiple-sided, in particular three-sided lattice girders made of fibre composite material, tubes (6, 7, 8, 9) are provided and arranged so that one of these is in the centre and the others are evenly distributed around this tube receiving or forming a central member, are held together by a fibre ring winding (12) and held apart by a disc (16) provided in the central tube (6).

19 Claims, 2 Drawing Sheets

CONNECTING ELEMENT FOR MULTIPLE-SIDED, IN PARTICULAR THREE-SIDED LATTICE GIRDERS

BACKGROUND OF THE INVENTION

1. Field of the Invention

The invention relates to a connecting element for multiple-sided, in particular three-sided lattice girders.

2. Discussion of the Related Art

Three-sided lattice girders are structural elements frequently used in light construction work. Their cross-section is in the form of an equilateral triangle, at the corners of which three frame members or chord members are located. For reinforcement diagonal members are either arranged alone or diagonal and cross members are arranged together between the chord members. In association with a relatively low weight, high longitudinal and transverse forces as well as high bending moments can be transmitted with three-sided lattice girders.

It is therefore known to use them in the form of welded constructions made of steel or aluminium in numerous fields of application, e.g. in crane construction, tent construction, antenna construction etc. It is also known thereby to direct the three chord members together at the ends of the girders to form a bearing or connection point. This may be achieved extremely easily in welded constructions.

It is also known that lattice girders made of fibre composite materials, in particular carbon fibre composites (CFRP), with the same rigidity and strength as aluminium have only about half the weight of aluminium structures. The individual members cannot be welded to one another when lattice girders made of CFRP are used.

SUMMARY OF THE INVENTION

Therefore, the object forming the basis of the invention is to provide a connection possibility for multiple-sided, in particular three-sided lattice girders, which is suitable for use with lattice girders made of fibre composite materials, which are directed together to form a bearing or connection point.

As a result, a connecting element is provided in particular for three-sided lattice girders which transmits both compressive and tensile forces in an optimum manner in particular from three chord members to a central member. Transverse forces also occurring upon this load application are likewise absorbed by the arrangement of the connecting element according to the invention. Separation of the outer chord members from the central member does not occur, nor does a compression of the inner central member by the outer chord members.

Since, in the example of a three-sided lattice-girder, the three tubes of the connecting element are arranged at an angle of 120° to one another and a further tube is provided in the center, whereby the three outer tubes abut closely against the central tube, an optimum distribution of forces occurs over the circumference of the three-sided lattice girder. The advantageous use of a ±45° woven fabric for the tubes assures a high shear strength and resistance.

In principle, a connecting element for multiple-sided, in particular three-sided lattice girders is made from fibre composite materials, in which tubes are provided and arranged so that one of these is in the center and the others are evenly distributed around this tube receiving or forming a central member, are held together by a fibre ring winding and held apart by a disc provided in the central tube. The outer tubes preferably closely abut against the central tube. Three tubes are preferably provided which are evenly distributed over the circumference, i.e. in a 120° arrangement. The chord members of the three-sided lattice girder are inserted into the tubes.

The tubes are preferably made from a ±45° woven fabric. This is laid around the removable chord members such that it forms at least two thrust or shearing webs from the central tube formed to each of the outer tubes formed. This is achieved by looping the ±45° woven fabric alternately around the chord members. The thickness of the thrust or shearing webs formed can preferably be adapted to the loads to be transmitted. It may be predetermined in particular by the number of ±45° woven fabrics used.

After the tubes have been formed, the fibre ring winding envelops the entire arrangement from the outside. The shape of an equilateral triangle thus results in plan view. The fibre ring winding has a specific height which is also dependent on the loads to be transmitted. Namely, the fibre ring winding serves to absorb transverse tensile forces. It preferably has a fibre of high tensile strength. Such transverse tensile forces occur when pressure is applied to the lattice girder. They assist the release of the preferably three chord members from the central member. If the lattice girder is subjected to a tensile load, the outer chord members conversely press against the central member.

To absorb these pressure forces a disc is set into the central tube of the connecting element. This is preferably a round disc made of multi-directional fibre laminate. It is preferably arranged in the region of the bends of the three outer chord members and absorbs the compressive forces emanating from these.

BRIEF DESCRIPTION OF THE DRAWINGS

For more detailed explanation of the invention an embodiment of a connecting element according to the invention for multiple-sided, in particular three-sided lattice girders is described below on the basis of the drawings.

DETAILED DESCRIPTION

Figure 1:
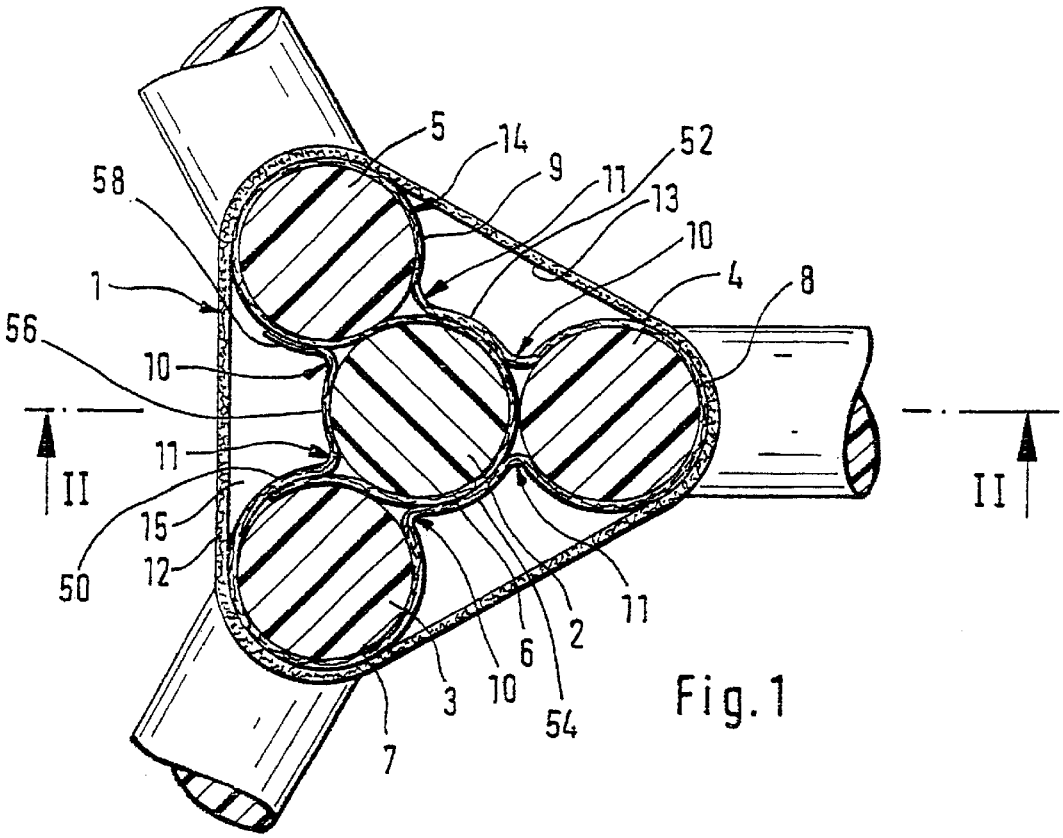
FIG. 1 shows a cross sectional view through a connecting element according to the invention for a three-sided lattice girder.

FIG. 1 shows a cross-sectional view of a connecting element 1 according to the invention for a three-sided lattice girder. The three-sided lattice girder has a central member 2 and three chord members 3, 4, 5, which are spaced at 120° to one another around the central member 2. The three outer chord members 3, 4, 5 have a portion standing perpendicular to the plane of the drawing, to which the connecting element 1 is attached and angled portions provided with an angle to the plane of the drawing. These are shown in dotted lines.

The connecting element 1 has four tubes, a central tube 6 and three outer tubes 7, 8 and 9. The four tubes envelop the three chord members 3, 4, 5 and the central member 2. The tubes 6, 7, 8, 9 are made from a ±45° woven fabric. This woven fabric is laid around the central member 2 and the chord members 3, 4 and 5 such that these members remain removable and the woven fabric forms at least two thrust or shearing webs 10, 11 from the central tube 6 to each of the outer tubes 7, 8 and 9.

In FIG. 1, the woven fabric is initially partially laid around the chord member 3 beginning at a point 50. From there it is passed between member 3 and member 2 between 2 and member 4 and around the central member 2, approximately around 240°. The woven fabric is then passed between member 3 and member 5 and laid around the chord member 5 and extended to central member 2 to form a web 11 in the connecting element 1 between central tube 6 and outer tube 9. The central tube 6 is then in turn enveloped on one portion 52 by the woven fabric. Two layers of the woven fabric are now provided one above the other in this portion 52. A web 10 between chord member 4 and central member 2 is then formed. The woven fabric then envelops chord member 4 to such an extent that a web 11 between member 4 and tube 6 can be formed. Tube 6 is once again partially enveloped at a region 54 until a web 10 to chord member 3 can be formed. Two layers of the woven fabric are also provided in this region 54 of tube 6. The woven fabric then partially envelops chord member 3 and extends to central member 2 to form a web 11 between outer tube 7 and central member 2. The woven fabric then partially envelops central member 2 at a region 56 and then extends to tube 9 to form a web 10 between central member 2 and tube 9. Tube 9 is partially enveloped at a region 58, resulting in a double layer of woven fabric in tube 9 at this region 58. The woven fabric is preferably glued onto the woven fabric of tube 9 arranged beneath it in this portion. A frictionally engaged connection of the woven fabric layers to one another is provided as a result of this.

Multiple-layer webs may also be provided instead of the two single-layer webs to each of the outer tubes. The respective thickness of the webs 10, 11 is selected in dependence upon the loads to be transmitted. It is thereby predetermined and generated by the number of layers of the ±45° woven fabric used, and can be varied on the basis of this.

The outer tubes 7, 8, 9 are enveloped on their outsides by a fibre ring winding 12. The fibre ring winding 12 should absorb the transverse tensile forces generated upon subjection of the pyramid-shaped three-sided lattice girder by longitudinal load application and thus generated at the deflections of the chord members. In dependence upon the preceding sign of the longitudinal forces which act on the entire pyramid-shaped three-sided lattice girder, the three outer chord members 3, 4, 5 are pressed either apart or together. The transverse tensile forces thereby cause the three outer chord members to be pressed apart i.e. released, from the central member 2. The fibre ring winding 12 therefore is advantageously made of a fibre of high tensile strength. Its ends are preferably glued onto one another or fastened by other means, whereby a simple fixing means is sufficient.

The cavities 15 between the inside 13 of the fibre ring winding 12 and the outsides 14 of the tubes 6, 7, 8, 9 can be filled with foam. A light foam material should be used for this. The foam material merely serves as a filling material for the skeleton connection. Therefore, it is also sufficient to merely enclose these remaining cavities.

The outer chord members are pressed against the central member when the three-sided lattice girder is subjected to a tensile load. The central member 2 is provided with a disc 16 in order to absorb these compressive forces. The disc 16 is shown in the sectional view of the connecting element 1 according to FIG. 2. The disc 16 is set into the central tube 6 on the underside 17 of the central member 2. The disc 16 has the same outer form as the central member, i.e. is round in the embodiment. It is arranged in the region of bends 18 of the three chord members 3, 4, 5. It is fabricated from a suitable material capable of absorbing the pressure forces emanating from the chord members. Therefore, it is preferably made from a multi-directional fibre laminate.

Figure 2:
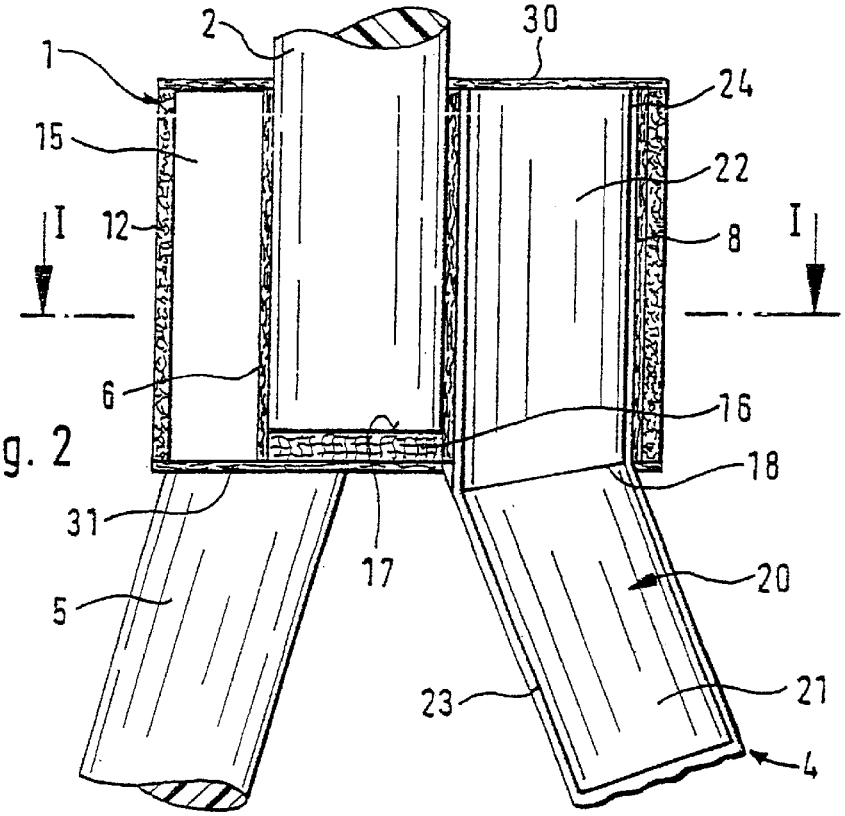
FIG. 2 shows a side-sectional view of the connecting element according to FIG. 1.

The structure of a second half of the elbow or bend 18 of the chord member 4, may also be seen in FIG. 2. An angle element 20 is inserted into the chord member 4. The angle element 20 is made of a fibre composite material. It is prefabricated and comprises numerous fibre roving strands which fold when in stretched arrangement. They are held together by means of tube elements 23, 24 in the region of the two limbs 21, 22 of the angle element 20.

As is clearly evident in FIG. 2, the connecting element 1 is arranged at the end of the central member 2 in the region in which the three chord members are directed parallel again and form a bearing or connection point. Longitudinal forces acting in the central member are directed into the three outer chord members and thus into the three-sided lattice girder.

The upper side of the connecting element 1 is covered by a cover 30 made of a fibre laminate. The underside of the connecting element is similarly covered by a cover 31 made of fibre laminate. These covers 30, 31 are provided on the one hand for aesthetic or optical purposes. On the other hand, they provide protection against any moisture or similar which may penetrate into the connecting element. In addition, a cavity in the central tube 6 is defined by the lower cover 31 which may be filled with resin for insertion and adhesion of the central member 2.

Figure 3:
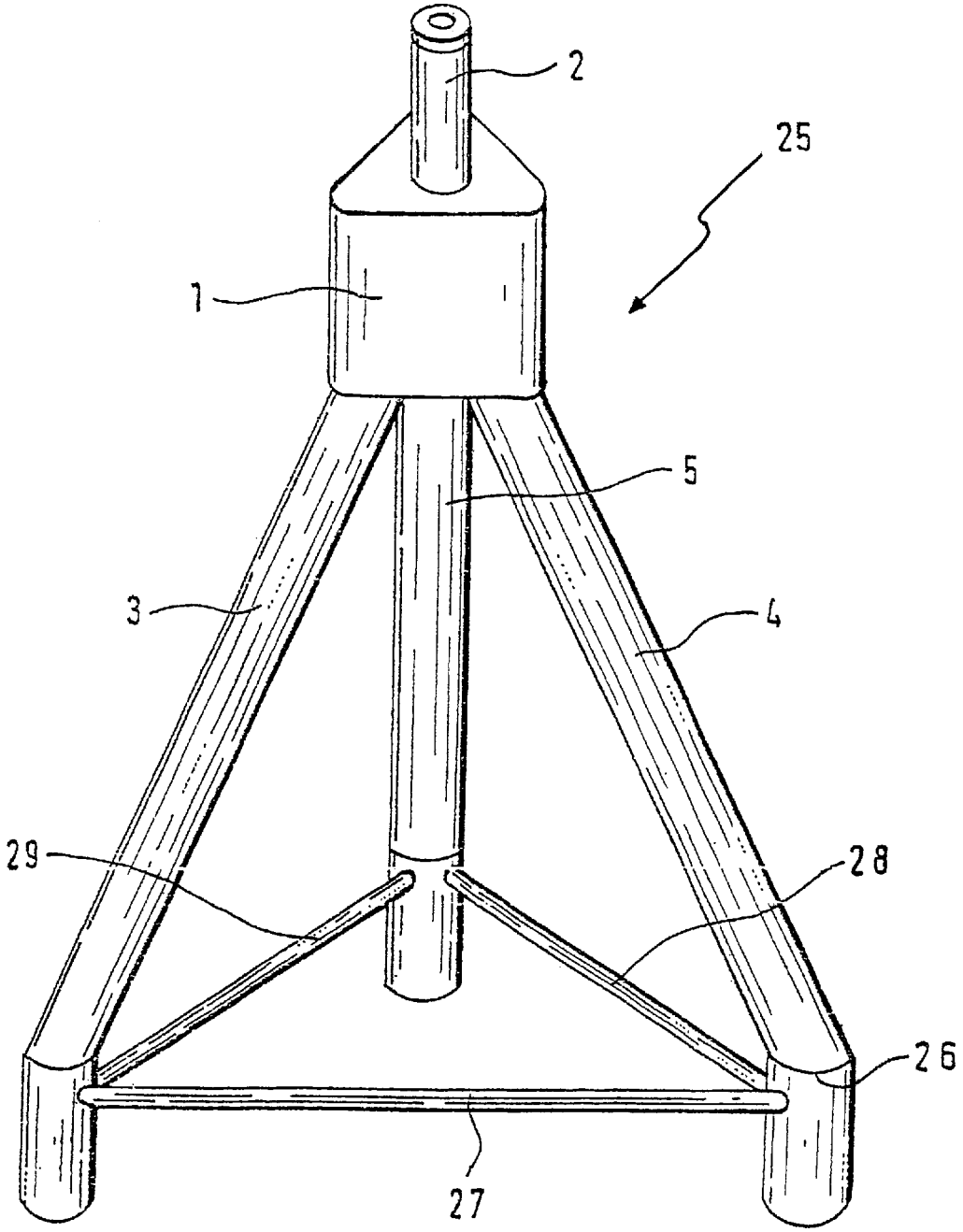
FIG. 3 shows a perspective view of a three-sided lattice girder with the connecting element according to FIG. 1.

FIG. 3 shows a perspective view of a three-sided lattice girder 25 with a connecting element 1 according to FIG. 1. The chord members 3, 4, 5 running obliquely towards the connecting element 1 are also provided with a bend 26 in their lower region. This bend can be formed in accordance with the bend 18 described in FIG. 2. The second bend causes the three outer chord members 3, 4, 5 to be directed parallel to each other. Transverse forces may also occur in the region of these bends or deflections of the chord members when the pyramid-shaped three-sided lattice girder 25 is subjected to longitudinal load. Cross members 27, 28, 29 are arranged between the individual chord members 3, 4, 5 to absorb these transverse forces. Each chord member 3, 4, 5 is connected to the adjacent chord member by means of a cross member 27, 28, 29.

The embodiment is only described for a three-sided lattice girder. Alternative configurations may relate to other multiple-sided lattice girders, e.g. four-sided or six-sided lattice girders. The respective arrangement of the outer chord members around the central member then varies with respect to the angle arrangement of the individual members relative to one another. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

Reference Numerals

1 connecting element
2 central member
3 chord member
4 chord member
5 chord member
6 tube
7 tube

8 tube
9 tube
10 web
11 web
12 fibre ring winding
13 inside
14 outside
15 cavities
16 disc
17 underside
18 bends
20 angle element
21 limb
22 limb
23 tube element
24 tube element
25 three-sided lattice girder
26 bend
27 cross member
28 cross member
29 cross member
30 cover
31 cover

What is claimed is:

1. A connecting element for a multiple-sided lattice girder, the connecting element being made of fiber composite material and comprising a number of tubes constructed and arranged such that one tube is formed as a central tube and the others are formed as outer tubes, evenly distributed around the central tube, said central tube receiving a central member, said number of tubes being held together by a fiber ring winding, said central tube being reinforced by a disc provided in the central tube.

2. The connecting element according to claim 1, wherein the outer tubes closely abut against the central tube.

3. The connecting element according to claim 2, comprising three said outer tubes evenly distributed over the circumference of the central tube, said outer tubes having an angle of 120° between one another.

4. The connecting element according to claim 3, wherein said central tube and said outer tubes are formed from a ±45° woven fabric.

5. The connecting element according to claim 4, the ±45° woven fabric is laid around a plurality of removable chord members of a multiple-sided lattice girder such that, said plurality of chord members including a central chord member and a plurality of outer chord members, said woven fabric forms at least two webs between the central tube and each of the outer tubes.

6. The connecting element according to claim 5, wherein a thickness of each of said webs is varied to accommodate varying loads which are transmitted through the girder.

7. The connecting element according to claim 6, wherein the thickness of each of said webs is determined by the number of layers of the ±45° woven fabric used to form said webs.

8. The connecting element according to claim 5, wherein said disc has a shape which corresponds to the cross-section of the central tube, said disc being disposed within said central tube proximate a region of bends in the outer chord members to absorb transverse compressive forces transmitted through said outer chord members.

9. The connecting element according to claim 8, wherein the disc is made of a multi-directional fibre composite laminate.

10. The connecting element according to claim 1, wherein said ring winding is formed from high tensile strength fiber for absorbing transverse tensile forces.

11. A device for connecting a plurality of chord members to form a girder comprising:

an elongate connecting element including a continuous, unitary web of material looped so as to define a central tube constructed and arranged to receive a central member therein and a plurality of outer tubes constructed and arranged to each receive a chord member therein, said outer tubes being arranged equidistant from each other and around a periphery of said central tube, wherein said web of material separately envelops the central member and each of the chord members upon insertion of the central member and each of the chord members within said connecting element.

12. The device of claim 11, wherein said connecting element includes three said outer tubes having an angle of 120° between them.

13. The device of claim 12, wherein said central tube comprises a reinforcement constructed and arranged to strengthen said central tube against forces transmitted through said outer tubes.

14. The device of claim 13, wherein said reinforcement is a disc disposed proximate an end of said central tube.

15. The device of claim 11, in combination with the chord members, each of said chord members including an elongate section coupled to an extension at a junction, wherein an obtuse angle is formed between said elongate section and said extension at said junction.

16. The device of claim 11, wherein said central tube and each of said outer tubes has a longitudinal axis, each of the longitudinal axis being parallel to each other, said connecting element further comprising a reinforcement disposed within said central tube.

17. The device of claim 16, wherein said connecting element has a first end and a second end, wherein said central tube receives the central member through said first end of said connecting element and each of said outer tubes receives one of the chord members through said second end of said connecting element.

18. The device of claim 11, wherein said woven material comprises a fabric having fibers which are oriented at 45° to adjacent fibers of the fabric.

19. The device of claim 11, further comprising a winding which is coupled to an outer surface of each of said plurality of outer tubes, said winding encircling each of said outer tubes, thereby reinforcing said connecting element against transverse forces transmitted through said central tube and said plurality of outer tubes.

* * * * *